United States Patent [19]

Stil

[11] Patent Number: 4,940,917

[45] Date of Patent: Jul. 10, 1990

[54] COLOR CATHODE RAY TUBE HAVING AN IN-LINE ELECTRON GUN

[75] Inventor: Lambert J. Stil, Eindhoven, Netherlands

[73] Assignee: U.S. Philips Corporation, New York, N.Y.

[21] Appl. No.: 224,086

[22] Filed: Jul. 25, 1988

[30] Foreign Application Priority Data

Jul. 29, 1987 [GB] United Kingdom ..... 8717984

[51] Int. Cl.[5] ..... H01J 29/50

[52] U.S. Cl. ..... 313/414; 313/412; 313/413; 313/458

[58] Field of Search ..... 313/412–414, 313/449, 458

[56] References Cited

U.S. PATENT DOCUMENTS

| | | | |
|---|---|---|---|
| 4,334,169 | 6/1982 | Takenaka et al. | 313/414 |
| 4,473,775 | 9/1984 | Hosokoshi et al. | 313/414 X |
| 4,626,738 | 12/1986 | Gerlach | 313/414 |
| 4,812,706 | 3/1989 | Baudry et al. | 313/414 |

FOREIGN PATENT DOCUMENTS

| | | | |
|---|---|---|---|
| 225245 | 6/1987 | European Pat. Off. | 313/414 |
| 50748 | 3/1982 | Japan | 313/414 |
| 2031221 | 4/1980 | United Kingdom . | |

*Primary Examiner*—Donald J. Yusko
*Assistant Examiner*—Michael Horabik
*Attorney, Agent, or Firm*—Robert J. Kraus

[57] ABSTRACT

A color cathode ray tube having an integrated electron gun structure including mirrored main focusing and accelerating electrodes (46B, 52). The electron gun comprises a triode section formed by three in-line arranged cathodes (27, 28, 29) and first and second grid electrodes (30, 36) whose apertures are symmetrically disposed about respective central (21) and outer (32, 34) axes which pass through their respective cathodes. A prefocusing electrode (38) having eccentric outer apertures is positioned next to the second electrode (36). The field produced by the prefocusing electrode (38) serves to converge the electron beams produced in the triode section. At leasst one, but more conveniently two, further electrode(s) (40, 46A) are provided between the prefocusing electrode (38) and the main focusing lens electrode (46B). The outer apertures (say the apertures 44) of at least one of the further electrodes are elongated to provide an asymmetrical lens field which is used to neutralize spot errors, beam displacement and beam asymmetry. The shapes of the elongated apertures (44) are such that a portion of their peripheries are concentric about the axes (32, 34).

8 Claims, 2 Drawing Sheets

COLOR CATHODE RAY TUBE HAVING AN IN-LINE ELECTRON GUN

BACKGROUND OF THE INVENTION

The present invention relates to a colour cathode ray tube having an in-line electron gun.

Electron guns for colour cathode ray tubes are arranged to generate three electron beams whose paths of propagation lie in a plane which is generally horizontal. The electron guns may be constructed so that there is one discrete electron gun for each beam or so that they have a number of electrodes in common, a so-called integrated electron gun structure. Integrated electron gun structures are inherently more compact and in consequence are popular for use in those colour cathode ray tubes, such as narrow-necked and mini-necked colour cathode ray tubes in which space is a premium. When designing and constructing an electron gun for a colour cathode ray tube various types of errors have to be taken into account and an optimum comprimise has to be decided upon in order to minimize the errors. The types of errors which are of interest are core haze eccentricity (CHE), beam displacement (BD) and free fall error (FFE). Core haze eccentricity occurs when the haze which surrounds the spot proper at the screen is located eccentrically with reference to the centre of the spot. Beam displacement occurs in respect of relative positions of the outer electron beams to the center electron beam. Free fall error (FFE) is effectively the convergence error at the screen. FFE can be corrected by altering the pitches of the outer apertures with respect to the central aperture in the electrodes of the triode part of the electron gun to obtain a desired angle of trajectory. However this also has an effect on CHE and BD. CHE can be reduced by ensuring that the converging electron beams pass through the centers of their respective focusing lenses. In simple terms these errors can be grouped in two classes namely focusing errors and convergence errors. Furthermore unless special precautions are taken, measures to reduce the effects of one type of error make the other type of error worse.

British Patent Specification No. 2031221 A (PHN 9215) discloses an in-line electron gun assembly in which focusing and convergence are independently adjustable. In the embodiments of the electron guns disclosed the convergence of the outer electron beams takes place in the prefocusing part of the electron gun and the electron beam focusing is carried-out using a bipotential electron lens. An embodiment of an integrated electron gun assembly shown in FIG. 4 of Specification 2031221A has three in-line arranged cathodes, a first grid, a second grid, a prefocusing grid, a focusing electrode an an accelerating electrode, all the grids-/electrodes being orthogonal to the central longitudinal axis of the electron gun. Each grid/electrode has three in-line apertures of which the central ones are co-axial about said central longitudinal axis. However in order to obtain the required degrees of freedom the outer apertures in the prefocusing grid, the focusing electrode and the accelerating electrode are not only of differing sizes but their pitches, that is the distance from their centers to the central longitudinal axis, are different. Consequently no two grids/electrodes are the same.

Specification U.S. Pat. No. 4612474 discloses an in-line integrated electron gun having mirrored main focusing and accelerating electrodes. A pre-focusing electrode is provided between the triode (or beam forming) section of the electron gun and the main focusing lens. The outer apertures of the electrodes of the triode section are concentric about respective axes. The axes of the outer apertures in the pre-focusing electrode are displaced outwards relative to the first mentioned axes. Lastly the axes of the apertures in the main lens electrodes are displaced inwards relative to the first mentioned axes. By offsetting the axes in this way the outer electron beams are converged by the prefocusing lens. Such an arrangement provides two degrees of freedom, namely the eccentricity of the outer apertures in the pre-focusing electrode and the offsetting of the respective axes for optimising the spot error, beam displacement and beam asymmetry. Hence a compromise has to be made.

Another aspect to be considered is the assembly of the electrodes comprising the electron gun. Normally a jig is used having three substantially parallel insertion pins. Each pin has a plurality of steps of different cross-sectional area thereon which steps act as abutments for the mutual spacing of some of the electrodes in the axial direction, the mutual spacing of others of the electrodes being obtained by the use of spacers. Offsetting the axes of outer apertures in one or more electrodes requires the pins to be specially formed. This is both troublesome because the pins have to be specially formed and this constitutes an additional cost item because each type of electron gun requires its own jig.

SUMMARY OF THE INVENTION

An object of the present invention is to avoid having to compromise between FFE, BD and CHE.

According to the present invention there is provided a colour cathode ray tube having an electron gun structure for producing three electron beams whose paths of propagation constitute a single plane, the gun structure comprising a triode section consisting of in-line arranged central and two outer cathodes and first and second grid electrodes each having central and two outer apertures which are symmetrically disposed about respective axes passing through the cathodes; a third electrode having in-line arranged central and outer apertures, the outer apertures being eccentrically disposed about the respective axes passing through the outer apertures of the first and second grid electrodes; mirrored main focusing and final accelerating electrodes and means disposed between the third electrode and the main focusing electrode for producing asymmetrical electrical fields in the beam paths of the outer electron beams.

The invention is based on the recognition of the fact that at least three degrees of freedom for optimising FFE, BD and CHE are obtainable in an electron gun having mirrored lens and accelerating grid components by constructing the electron gun so that convergence is determined in the prefocusing section of the electron gun and so that other asymmetries are corrected by said means thereby enabling the outer electron beams to pass through the centers of their respective focusing lenses. By being able to provide at least three degrees of freedom compromises which have been necessary in some prior electron guns having only two degrees of freedom are unnecessary.

In embodiments of the present invention the asymmetrical electrical field producing means may comprise one or two further electrodes. The outer apertures in the one or at least one of the two further electrodes are elongate in the plane of the electron beams.

To facilitate assembly of the electrodes of the electron gun structure on insertion pins, at least a portion of the periphery of each of the elongate apertures which intersects and crosses the in-line plane, is concentric about its respective one of the axes passing through the outer apertures in the first and second grid electrodes. The direction of elongation is either towards or away from the central aperture of the relevant further electrode. By elongating the holes in this manner, a standard set of mounting pins can be used to assemble several different types of electron guns which not only introduces an element of flexibility but also a cost saving.

BRIEF DESCRIPTION OF THE DRAWING

The present invention will now be described, by way of example, with reference to the accompanying drawing figures, wherein.

In the drawing figures corresponding reference numerals have been used to indicate similar parts.

DESCRIPTION OF THE PREFERRED EMBODIMENT

Figure 1:
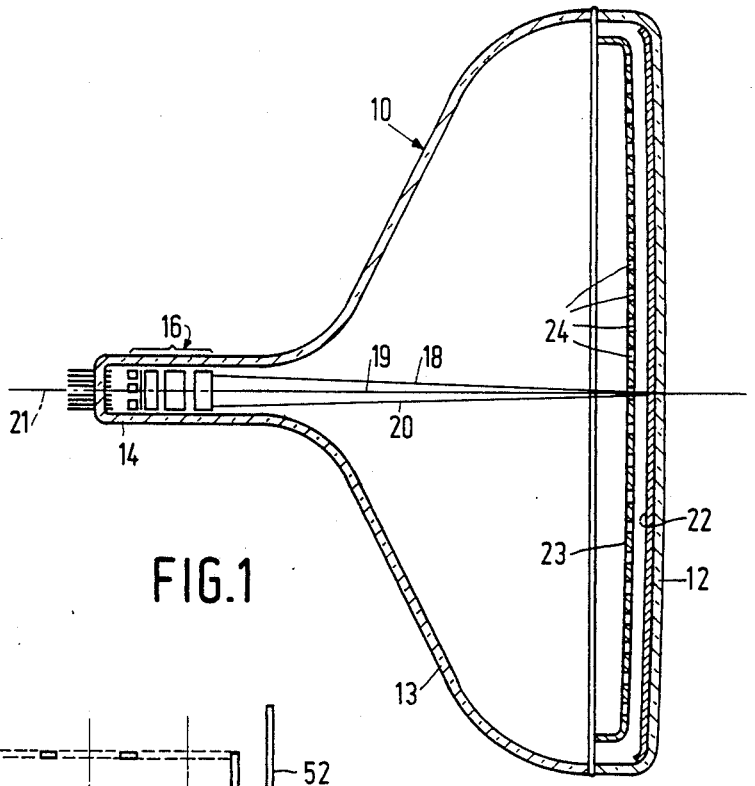
FIG. 1 is a cross-sectional view of a colour cathode ray tube having an in-line electron gun.

FIG. 1 is a cross-sectional view of a colour cathode ray tube including a glass envelope 10 having a neck 14, a display window 12 and a conical part 13. An integrated in-line electron gun 16 is provided in the neck 14 to generate three electron beams 18, 19, and 20. The axes of these electron guns are situated in one plane, the plane of the drawing. The longitudinal axis of the electron gun 16 coincides with the main axis 21 of the envelope. A display screen 22 comprising a large number of triplets of phosphor lines is provided on the inside of the display window Each triplet comprises a line consisting of a green luminescing phosphor, a line consisting of a blue luminescing phosphor and a line consisting of a red luminescing phosphor. The phosphor lines extend perpendicularly to the plane of the drawing. A shadow mask 23 having a large number of elongate apertures 24 parallel to the phosphor lines, through which apertures the electron beams 18, 19 and 20 pass, is placed before the display screen 22. Since the electron beams enclose a small angle with each other and converge on the display screen, each beam is incident only on phosphor lines of one colour via the elongate apertures.

Figure 2:
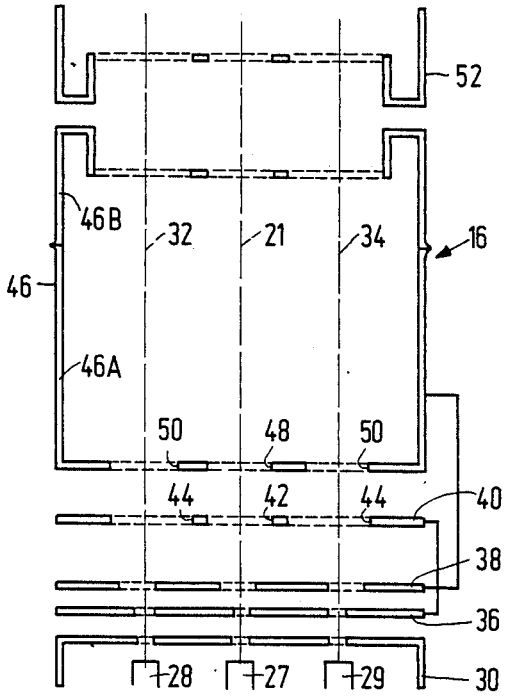
FIG. 2 is a cross-sectional view on the in-line plane of one embodiment of an electron gun used in the cathode ray tube shown in FIG. 1, FIGS. 3 and 4 are two alternative elevational views of a further electrode in which the pitch is altered by the outer apertures being elongated outwardly (FIG. 3) and inwardly (FIG. 4), and FIG. 5 diagrammatically illustrates the assembly of the electrodes of the electron gun on insertion pins.

Referring now to FIG. 2, the integrated in-line electron gun 16 shown may for convenience of reference be regarded as a quadri-potential focusing electron gun because of the manner in which the electrodes are connected. The electron gun 16 comprises a triode section formed by three cathodes 27, 28 and 29 and first and second grid electrodes 30, 36. The grids 30, 36 have central and outer apertures of substantially the same size. The central apertures in the first and second grids are symmetrically disposed about the main axis 21 and the side or outer apertures in the first and second grids are symmetrical about their respective axes 32, 34. A third, prefocusing grid electrode 38 is provided and has central and two outer apertures. The central aperture is coaxial about the axis 21 whereas the outer apertures are eccentric with respect to the axes 32, 34 thereby introducing the major part of the convergence to the electron beams passing therethrough. A fourth grid electrode 40 follows the third grid 38. In the presently described example this grid 40 has a circular central aperture 42 which is co-axial of the main axis 21 and asymmetrical outer apertures 44 whose axes of symmetry are not coincident with the axes 32, 34. These apertures 44 are made asymmetrical by elongating an otherwise circular aperture outwardly (FIG. 3) or inwardly (FIG. 4) in the direction of the in-line plane. In either case the elongate apertures 44 are of greater area than the central aperture 42. The non-elongated peripheral portions of the apertures 44 which intersect and cross the in-line plane are co-axial with respect to their axes 32, 34.

A fifth electrode 46 comprises two cup-shaped members 46A, 46B which are joined together at their rims. The central aperture 48 and the outer apertures 50 of the member 46A are coaxial about their respective axes 21, 32 and 34. In the present example the apertures 48 and 50 are of the same size as the aperture 42 in the electrode 40.

The electrodes 40, 46A co-operate to produce asymmetrical electric fields for the outer electron beams, which fields provide two extra degrees of freedom to those already provided by the pitches of the apertures in the first and second electrodes 30, 36 and the eccentricity of the outer apertures in the pre-focusing electrode 38. These extra degrees of freedom can be used to neutralise spot error, beam displacement and beam asymmetry. These extra degrees of freedom are obtained by varying the pitch which is achieved by the elongate shape of the holes, when present in the electrodes 40, 46A and suitably adjusting the mutual distances between the electrodes 40, 46A. For convenience of illustration the apertures 44 have been made elongate. However in alternative non-illustrated embodiments of the present invention the apertures 50 in the electrode 46A are asymmetric and of greater area than that of the central aperture whilst the apertures 44 are circularly symmetrical and coaxial about the axes 32, 34 the outer apertures 44 and 50 in both the electrodes 40, 46A are asymmetric and are of greater area than that of the respective central apertures or the asymmetric electric field is produced by a single electrode, say the electrode 46A, the electrode 40 having been omitted.

The cup-shaped member 46B constitutes the main focusing electrode and together with an accelerating electrode 52 forms lens fields for the final focusing of the electron beams. The member 46B and the electrode 52 are mirrored electrodes so that any distortion introduced into the electron beam(s) due to an imperfection in one of these electrodes is compensated at least in part by the corresponding imperfection in the other of these electrodes. Each electrode 46B and 52 is formed as a "bath tub" electrode comprising a peripheral rim and a base portion in which three in-line arranged apertures are provided. The apertures may be of polygonal shape, for example as disclosed in European Patent Specification No. 0134059 corresponding to U.S. Pat. No. 4,626,738 (PHN 10.752), details of which are incorporated by way of reference.

By electrically interconnecting the electrodes 36 and 40 and the electrodes 38 and 46, the electron gun can be operated as a quadri-potential electron gun by applying 0 V to the electrode 30, 500 V to the electrodes 36 and 40, 7750 V (31% of the final anode voltage) to the electrodes 38 and 46 and 25 kV to the accelerating electrode 52.

Figure 4:
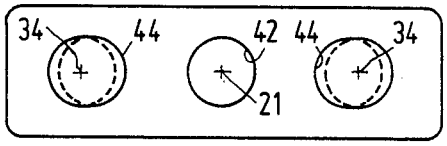

In the embodiment illustrated in FIGS. 2 and 4 the spacings (S) between the respective electrodes are $S_{27,30}=0.08$ mm $S_{30,36}=0.405$ mm $S_{36,38}=1.0$ mm $S_{38,40}=1.0$ mm $S_{40,46}=1.0$ mm $S_{46,52}=0.9$ mm The axial thicknesses (or axial lengths) (d) of the electrodes are $d_{30}=0.085$ mm $d_{36}=0.30$ mm $d_{38}=0.40$ mm $d_{40}=0.80$ mm $d_{46}=20.00$ mm The nominal pitch, that is, the distance between the central axis 21 and the outer axis 32 or 34 is 4.86 mm. However the pitch of the eccentric apertures in the third grid electrode 38 with respect to the axis 21 is 4.91 mm. In the case of the elongate apertures 44 in the grid electrode 40, the pitch is measured to the axis of symmetry of the elongate hole and in this example the pitch has a value of 4.77 mm. The outermost surfaces of the apertures are circular having their centers of curvature coinciding with the axis 32, 34, respectively. The diameter of the apertures in the electrodes 30, 36 is 0.6 mm, that of the apertures in the electrodes 38 and 46A are 1.15 mm and 3.0 mm, respectively. In the case of the aperture 42 in the electrode 40, its diameter is 3.0 mm whereas the elongate apertures 44 are effectively formed by two overlapping circles of 3.0 mm diameter, with a distance of 0.18 mm between their centers.

Figure 3:
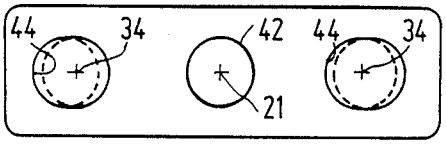
Figure 5:
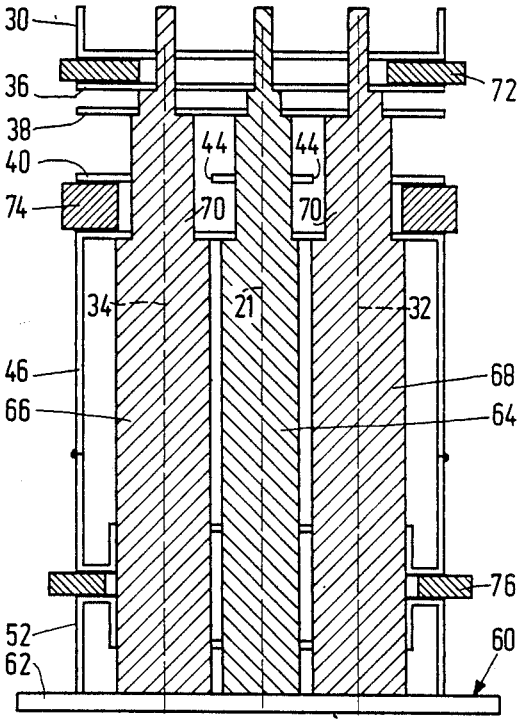

FIG. 5 illustrates a jig 60 on which the electrodes constituting an integrated electron are assembled prior to their being fixed together by means of glass rods (not shown). The jig 60 includes a base member 62 on which three upstanding insertion pins 64, 66, 68 are provided. The steps formed on each of the pins 64, 66 and 68 are such that some of the grids and electrodes can rest against an abutment thereby ensuring their relative axial positions whilst others are separated from each other by spacers 72, 74 and 76. Additionally in order to obtain the correct alignment it is necessary to ensure that there is no lateral misalignment and/or rotational misalignment. These possible misalignments can be avoided by machining accurately the correct profiles on the pins 61, 66 and 68. However, this would mean that each jig is only suitable for a particular electron gun and not for a range of electron guns. This need not be the case in respect of the electron gun used in the colour cathode ray tube made in accordance with the present invention because by elongating the apertures 44 in the electrode 40 so that at least a portion of their peripheries are concentric with the respective axes 32, 34 it is possible to effect the necessary changes required to obtain the desired extra degrees of freedom but at the same time obtain the required alignment of the electrodes. In order to obtain this flexibility, the relevant step 70 on the outer insertion pins 66, 68 is circular having a diameter corresponding to the nominal diameter of the concentric portion of the apertures 44 that is 3.0 mm in the numerical example given above. Thus if the apertures 44 are elongated outwards as shown in FIG. 3, the inner peripheral portions bear against the steps 70 on the pins 66, 68 and if the apertures 44 are elongated inwards as shown in FIG. 4 then their outer peripheral portions bear against the step 70 on the pins 66, 68. In either case lateral displacement and rotational displacement of the electrode 40 is prevented.

What is claimed is:

1. A color cathode ray tube including an envelope containing a luminescent screen and an electron gun for producing three in-line electron beams directed toward said screen, said electron gun comprising:

a. a triode section for forming the electron beams, said triode section including, in order:
   (1) central and first and second outer cathodes disposed on respective central and first and second outer in-line axes for emitting electrons along said axes;
   (2) first and second adjacent electrodes, each having central and first and second outer apertures symmetrically disposed about the respective axes, for forming the emitted electrons into the electron beams;

b. prefocusing electrode means having central and first and second outer apertures disposed about the respective axes, said first and second outer apertures being eccentrically disposed about the respective axes to effect convergence of the electron beams proximate the screen;

c. error correcting electrode means including an electrode having central and first and second outer apertures disposed about the respective axes, said first and second outer apertures being eccentrically disposed with respect to the respective axes for correcting beam focusing errors; and d. a pair of spaced apart mirrored electrodes, each having central and first and second outer apertures disposed about the respective axes, for producing central and first and second outer main focusing field lenses for focusing the respective electron beams at the screen.

2. A color cathode ray tube as in claim 1 where the error correcting electrode means comprises spaced apart electrodes, each having central and first and second outer apertures disposed about the respective axes, the spacing between said electrodes and the pitch of the outer apertures in at least one of said electrodes relative to the pitch of the outer axes being adjusted to correct the beam errors.

3. A color cathode ray tube as in claim 1 or 2 where each of the outer apertures of the error correcting means electrode is elongated and includes a portion thereof crossing a plane in which said axes lie which is concentric about the respective one of said axes.

4. A color cathode ray tube as in claim 2 where one of the error correcting electrodes is mechanically connected to one of the mirrored electrodes, where the second electrode of the triode section is electrically connected to one of the error correcting electrodes, and where the prefocusing electrode is electrically connected to a closer one of the mirrored electrodes.

5. A color cathode ray tube as in claim 1 where the outer apertures in the error correcting electrode means are elongated.

6. A color cathode ray tube as in claim 5 where each of said elongated apertures includes a portion thereof crossing a plane in which said axes lie which is concentric about the respective one of said axes.

7. A color cathode ray tube as in claim 6 where said elongated apertures are elongated outwardly with respect to the central aperture.

8. A color cathode ray tube as in claim 6 where said elongated apertures are elongated inwardly with respect to the central aperture.

* * * * *